United States Patent [19]

Vergne

[11] Patent Number: 4,708,634

[45] Date of Patent: Nov. 24, 1987

[54] DRAWN ASSEMBLY FOR PULSATORY COMBUSTION

[75] Inventor: Bernard Vergne, Palaiseau, France

[73] Assignees: Societe Nationale Elf Aquitaine, Courbevoie, France; Mareck B.V., Amsterdam-Pays-Bas, Netherlands

[21] Appl. No.: 879,466

[22] Filed: Jun. 27, 1986

[30] Foreign Application Priority Data

Jun. 27, 1985 [FR] France ..... 85 09806

[51] Int. Cl.[4] ..... F23C 3/02

[52] U.S. Cl. ..... 431/1; 60/39.76; 432/194; 432/245; 432/249

[58] Field of Search ..... 431/1, 158; 60/39.77, 60/39.76; 122/24; 165/170; 29/157.5; 432/245, 249, 251, 252, 253

[56] References Cited

U.S. PATENT DOCUMENTS 3,853,453 12/1974 Olsson ..... 431/1
4,109,711 8/1978 Kleine et al. ..... 165/170
4,568,264 2/1986 Mullen et al. ..... 431/1

FOREIGN PATENT DOCUMENTS 81000610 3/1981 PCT Int'l Appl. .

*Primary Examiner*—Margaret A. Focarino
*Attorney, Agent, or Firm*—Oblon, Fisher, Spivak, McClelland, & Maier

[57] ABSTRACT

Assembly for pulsatory combustion comprising a combustion chamber, a horn and an exchanger part, made through drawing and welding of two half-shells, the separation plate being secured to the inside of the chamber in a recess provided for this purpose such an assembly being applied to domestic heating.

6 Claims, 6 Drawing Figures

DRAWN ASSEMBLY FOR PULSATORY COMBUSTION

BACKGROUND OF THE INVENTION

1. Field of the invention

The present invention concerns a novel chamber for pulsatory combustion, said chamber allowing pulsatory combustion of a mixture of fuel and comburent.

2. Description of the prior art

The theory of pulsatory combustion and its utilization for producing heating units is known to those skilled in the art. It is in particular described in French Patent No. 2 178 997 dated Apr. 2, 1973. In such units, the main chamber is provided with an assembly of lateral chambers, a plate dividing the main chamber into two compartments so that transversal the mixture of combustible and comburent material that penetrates the first of these compartments, in the direction of the transversal plate, is divided by this plate and is forced, in order to pass behind said plate, to cross through the lateral chambers.

According to the particular embodiment described in the above-mentioned patent, the main chamber comprises four lateral chambers, disposed around the axis connecting the input opening to the output opening and the transversal plate is secured to the walls of the chamber. This assembly is produced in a single piece by casting operations.

It is also foreseen that the plate and the chamber are made integral at several sites, thereby allowing an improved heat transfer to the wall of the main chamber. These attachment zones are disposed at sites of the wall of the main chamber that are situated between the lateral chambers.

One problem that is frequently encountered in this type of combustion chamber is that of the differential dilatation that can exist between the separation plate and the walls of the chamber since these elements can be brought to very different temperatures. So as to overcome these drawbacks, PCT application WO No. 81/00610 proposed to have the transversal plate presenting weakening zones situated along the length of two perpendicular axes intersecting at the center of the plate. During operating, and in particular during combustion in the chamber, the plate is ruptured along these lines and thus accepts these dimensional variations due to the differences in temperature while continuing to act as a separation plate.

In order to utilize these combustion chambers in complete boilers, all the elements are joined together by welding and soldering operations, which can give rise to certain problems during operation, in particular with respect to the connection between the tubular exchanger and the horn which ensures the passage of the burned and hot gases between the chamber and the exchanger.

SUMMARY OF THE INVENTION

A first object of the invention is to provide a combustion chamber that allows a simple realization and which, once mounted, does not present any sealing problems.

A second object of the invention is to provide a combustion chamber that also overcomes the problem of differential dilatation between the plate and the chamber.

In order to do this, the invention foresees a novel assembly for pulsatory combustion, said assembly comprising at least one pulsatory combustion chamber present in the form of a main chamber and at least two lateral chambers and wherein this assembly is constituted by at least two shells, produced by drawing, connected to each other and secured by welding in order to obtain the said chamber.

According to one particular embodiment, said assembly also comprises at least one part of a flat tubular assembly and a connecting horn between said chamber and the said part of the exchanger, wherein such is made of two shells that are assembled according to the general plane of the exchanger.

According to another feature of the present invention, the assembly comprises the whole of the flat exchanger, this exchanger comprising an uncoupling chamber into which issue all the tubes from the tubular exchanger.

It will thus be understood that according to the invention it is easily possible to obtain a complete, integral assembly through association of two drawn or stamped plates.

Each shell preferably comprises at the main chamber level, securing means for securing a separation plate while authorizing its transversal displacement.

According to a preferred embodiment, these securing means are constituted by recesses produced during the drawing operation and in which the intermediary plate can be inserted.

Furthermore, according to a particular embodiment of the invention, the combustion chamber comprises four lateral chambers disposed around the main chamber, each lateral chamber being situated immediately adjacent to the two other chambers, so that each wall of a chamber is substantially in contact with a wall of an adjacent chamber, the contact area of these two walls each defining a part of the wall of the central chamber, and the recesses are situated in said parts of the wall of the main chamber.

BRIEF DESCRIPTION OF THE DRAWINGS

Other features, objects and advantages of the invention will appear more apparent from the following description given as non-limitative illustration with reference to the appended drawings, in which.

DESCRIPTION OF THE PREFERRED EMBODIMENT

Figure 1:
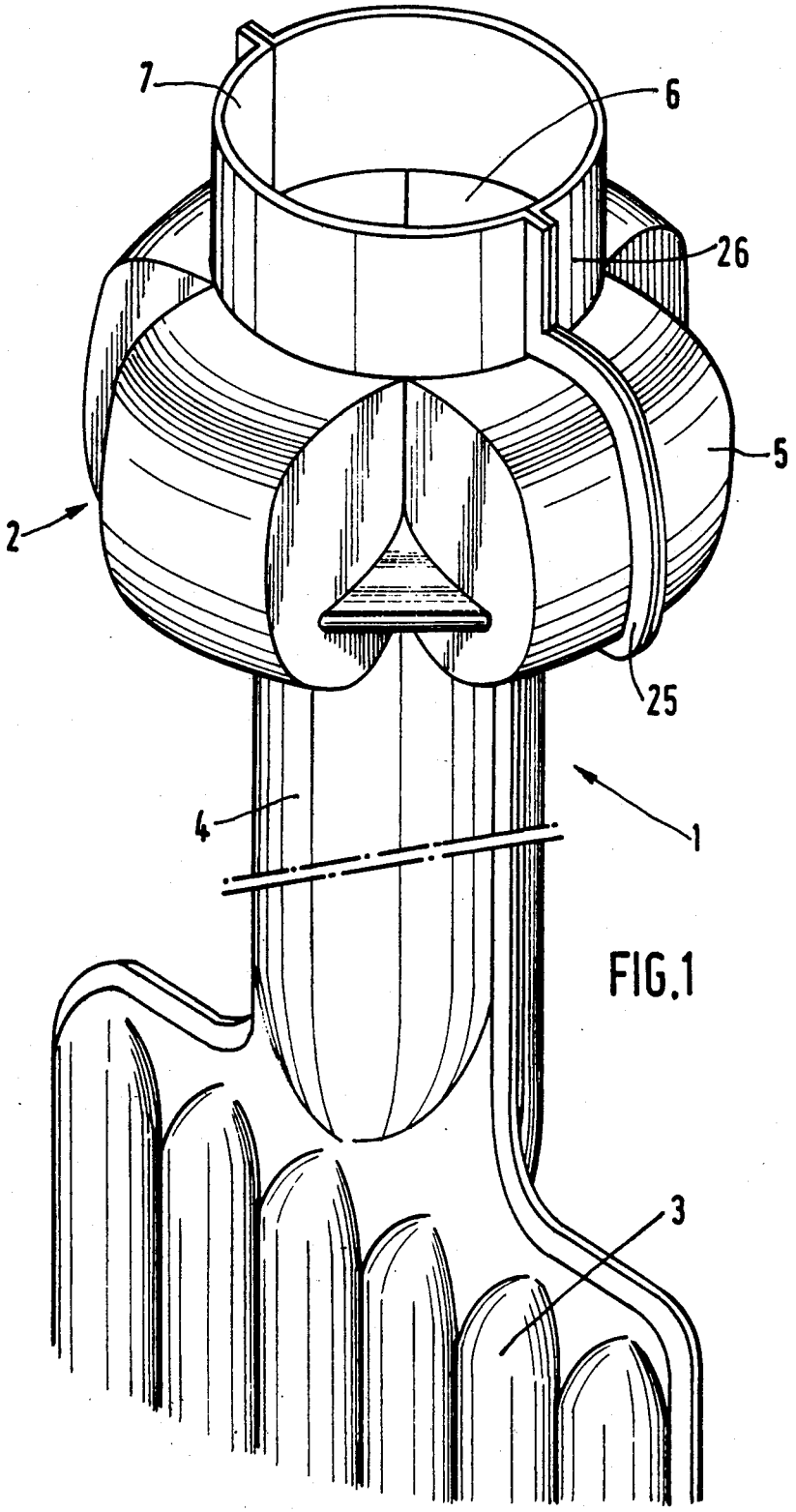
FIG. 1 is a view in perspective of a part of the assembly made according to the invention.

FIG. 1 represents an assembly 1 made according to the invention. It comprises a combustion chamber 2, a flat tubular exchanger 3 of which only the upper part has been represented. The combustion chamber 2 and the tubular exchanger are connected to each other by a horn 4 establishing a passage for the combustion gases.

The combustion chamber 2 comprises four lateral chambers, such as 5 and a central chamber 6 situated between the input tube 7 and the horn 4.

Figure 2:
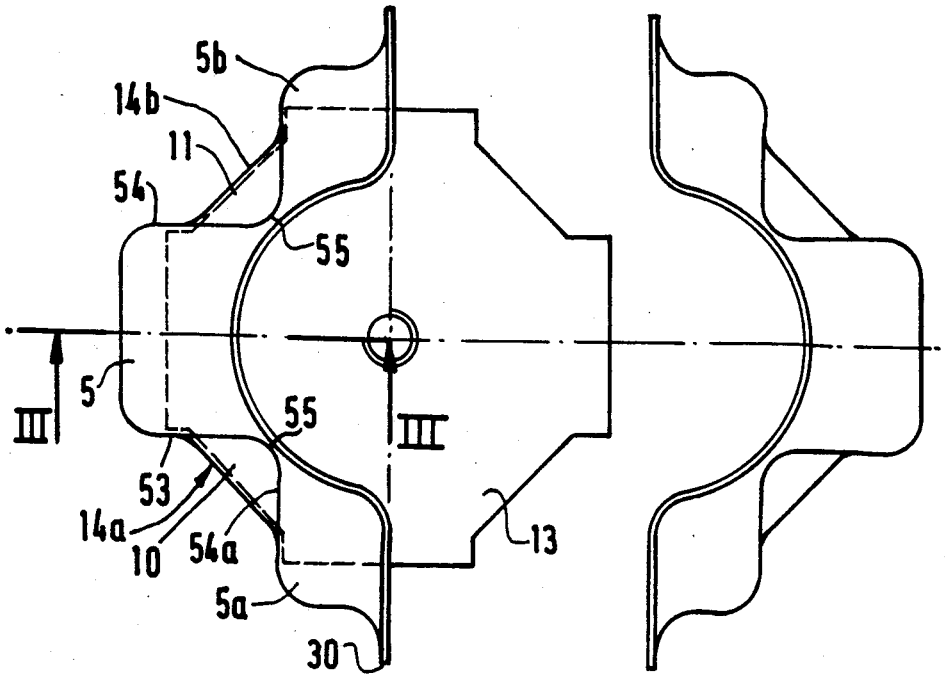
FIG. 2 is a view from above of the assembly represented in FIG. 1 prior to its assembling.
Figure 3:
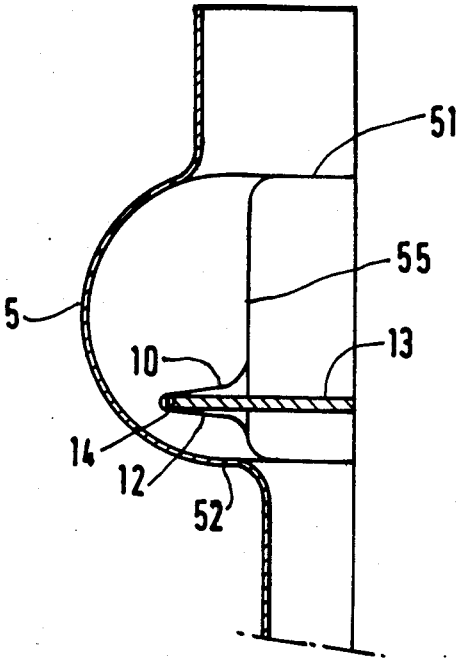
FIG. 3 is a half-section view of FIG. 2 according to axis III.

FIG. 2 is a half-view from above of the chamber 2. Between the lateral chambers such as 5, 5*a* and 5*b* the upper walls 10 and 11 of the pinched zones have been represented. Therefore, as appears more clearly from the cross-section of FIG. 3, each upper wall such as 10 and 11 is associated to a lower wall such as 12 and defines with said wall the recessed wall portion 14 (14*a*, 14*b*) in which is placed the separation plate 13. The recessed wall portion 14 has the form of a cavity produced through drawing.

Each lateral chamber such as 5 and 5*a* comprises lateral walls 51, 52 53 and 54 or 54*a*. The consecutive walls 53 and 54*a* meet in zone 55 that partially defines a wall of the central chamber 6. The recessed wall portions such as 14 are situated in the zone 55 and each extend between two consecutive walls 53 and 54*a*.

The plate 13 is set so as to have a minimum clearance between its ends and the bottoms of the recessed wall portions 14. According to the embodiment shown, the contact between the plate and the recessed wall portions 14 is quasi-linear but it is possible to confer any form upon the walls 10 and 12 provided it will allow a more or less extended contact surface.

A secure attachment of the plate is thus obtained but which allows transversal movements. For example, the plate can be expanded since under the effect of such a dilatation the walls 10 and 11 of recessed wall portions 14 will spread apart.

Figure 4:
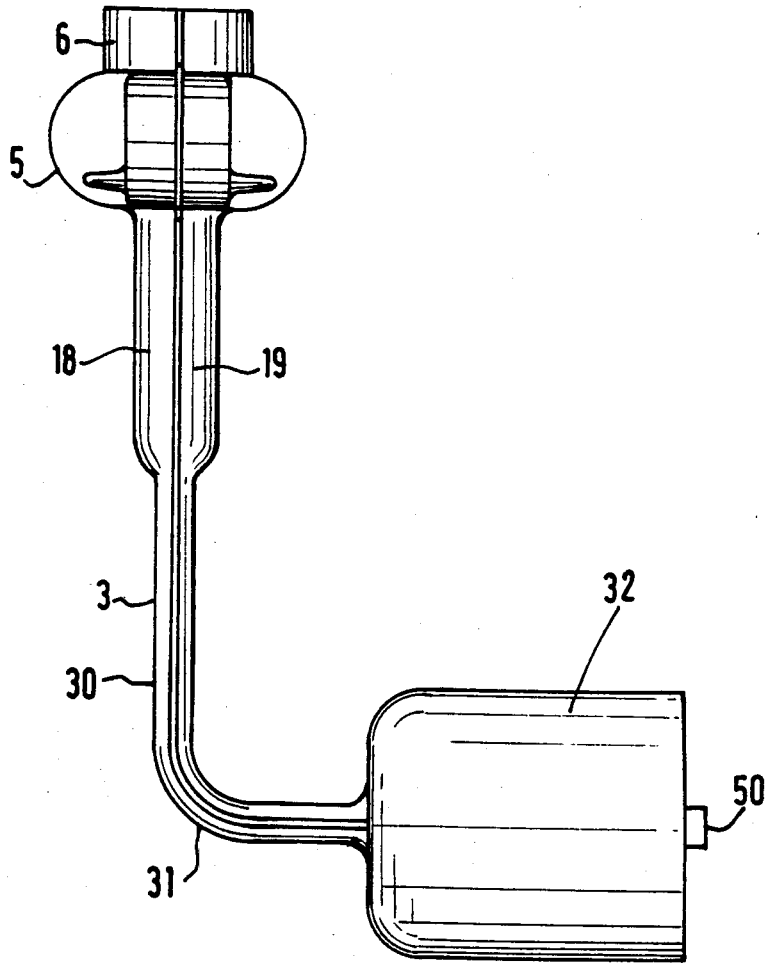
FIG. 4 is a side view of the assembly represented in FIG. 1.
Figure 5:
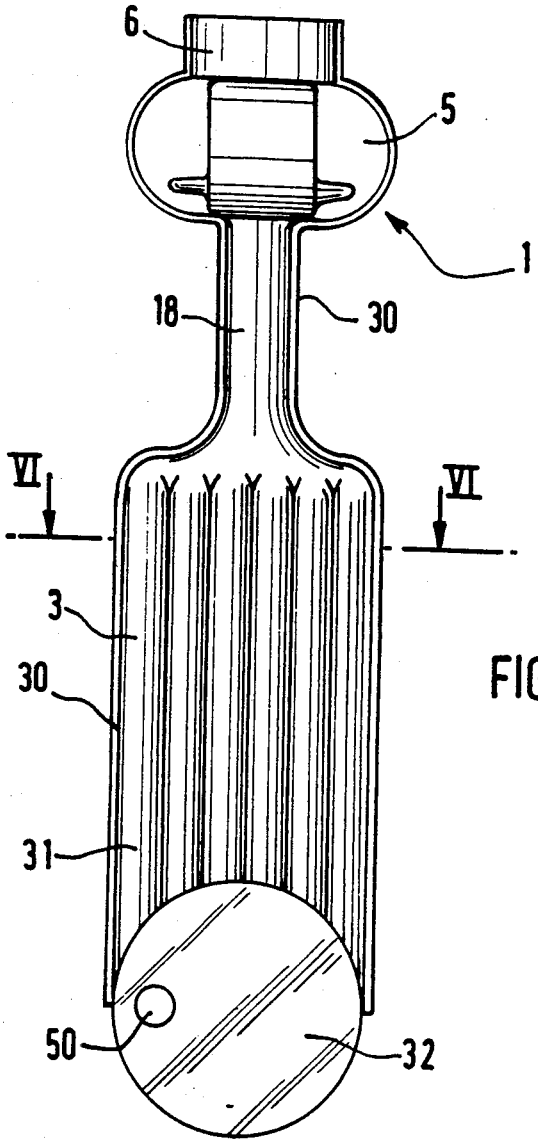
FIG. 5 is a front view of the assembly.

In order to produce the assembly shown in perspective in FIG. 1 and as a front view and side view in FIGS. 4 and 5, two stainless steel plates are drawn according to usual techniques in order to obtain two half-assemblies 18 and 19.

After the setting in position separation plate 13 inside a half-chamber through insertion in the recessed wall portions 14 and 14*a*, the plate is secured in one of the recesses by performing a welding spot. The two drawn half-assemblies are thereafter joined together and roll welded along their entire length according to a band 25 represented in FIG. 1.

According to one alternative embodiment, in the upper cylindrical part 26 corresponding to the input tubular piece 7, the tongue 25 is suppressed and the connection is performed by a TIG Tungsten Inert Gas welding that allows to reconstitute a perfect cylinder and simplifies the connection of the assembly thus obtained with the other members of the boiler.

The assembly produced is thus perfectly sealed.

Figure 6:
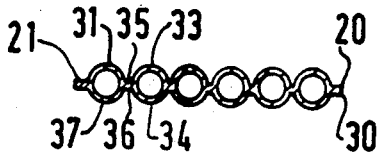
FIG. 6 is a cross-section view of FIG. 5 according to VI—VI.

During this operation, the exchanger is advantageously produced so as to have a cross-section which according to the axis VI.VI of FIG. 5 is represented in FIG. 6. The edges 20 and 21 are welded by the same T.I.G. welding rope 30. The two half-plates have been drawn so that each defines a series of half-tubes such as 31, 33 and 37, 34, each half-tube such as 31, 33 being separated from the adjacent half-tube such as 37, 34 by a flat band 35, 36. In order to achieve the tightness of the exchanger and prevent the tubes from communicating between one another a roll welding is performed on each flat strip.

But, according to the invention it is possible to advantageously produce an assembly comprising a complete exchanger constituted by the upper part 3, the central part 30, the lower part 31 and an uncoupling chamber 32.

The uncoupling chamber 32 is constituted by a cylindrical wall 35, a circular wall 36 constituting a bottom and a connection wall 37 between the tubes and the inside of the chamber. It is perpendicular to the general plan of the exchanger.

The chamber is made along with the rest of the assembly during drawing of the half-plates and the bottom plate is brought in and welded. Such comprises a tubular pipe 50 for the evacuation of the gas.

The interest of such an embodiment is to have a continuous connection between the tubes and the chamber.

The central part 30 of the exchanger can have any form and for example it is possible to provide a form such that the uncoupling chamber is located below the chamber 5 and is not shifted as shown in FIG. 4.

It is well understood that any other means of attachment of the half-plates may be utilized without departing from the scope and spirit of the invention. It is also possible to produce an assembly by means of more than two plates.

I claim:

1. An assembly for pulsatory combustion, comprising:

at least one pulsatory combustion chamber present in the form of a main chamber and at least two lateral chambers, wherein said at least two lateral chambers comprise at least two shells produced by drawing and interconnected to each other by welding wherein each of said at least two lateral chambers comprises at least one part of a flat tubular exchanger and a connecting horn between the said chamber and said exchanger, said assembly being made of two half-shells assembled along a plane of the tubular exchanger.

2. An assembly for pulsatory combustion, according to claim 1, wherein said at least two lateral chambers comprise an uncoupling chamber connected to said exchanger in a part thereof opposite the part connected to the horn.

3. An assembly for pulsatory combustion, comprising:

at least one pulsatory combustion chamber present in the form of a main chamber and at least two lateral chambers, wherein said at least two lateral chambers comprise at least two shells produced by drawing and interconnected to each other by welding and wherein each of said at least two shells comprises, with respect to the main chamber, securing means for securing a separation a separation plate within said main chamber and for allowing for transversal displacement.

4. An assembly for pulsatory combustion according to claim 3, wherein said securing means comprise drawn recessed wall portions into which is inserted the plate.

5. An assembly for pulsatory combustion according to claim 4, wherein said at least two lateral chambers comprise four lateral chambers disposed about the main chamber, each lateral chamber being situated between two adjacent lateral chambers, each lateral wall of a lateral chamber being substantially in contact with a wall of an adjacent chamber, wherein a contact zone of said two walls each define a part of a wall of the main chamber, and wherein the drawn recessed wall portions are situated in said parts of the wall of the main chamber.

6. An assembly for the pulsatory combustion according to claim 4, wherein the uncoupling chamber is cylindrical and sealed by a circular wall.

* * * * *